United States Patent [19]

Debaigt

[11] 4,256,360

[45] Mar. 17, 1981

[54] RAPID-CONNECTION TERMINAL

[75] Inventor: Jean Debaigt, Maisons Laffitte, France

[73] Assignee: Societe Anonyme dite: CGEE Alsthom, Levallois-Perret, France

[21] Appl. No.: 112,985

[22] Filed: Jan. 17, 1980

Related U.S. Application Data

[63] Continuation of Ser. No. 938,272, Aug. 30, 1978, abandoned.

[30] Foreign Application Priority Data

Sep. 21, 1977 [FR] France ..... 77 28402

[51] Int. Cl.[3] ..... H01R 4/10

[52] U.S. Cl. ..... 339/97 R; 339/107; 339/113 R

[58] Field of Search ..... 339/97 R, 97 P, 98, 339/99 R, 107, 210, 113 R

[56] References Cited

U.S. PATENT DOCUMENTS

| | | | |
|---|---|---|---|
| 2,128,883 | 8/1938 | Burt | 339/107 |
| 3,167,375 | 1/1965 | Sarazew | 339/99 R |
| 3,550,066 | 12/1970 | Cootes | 339/107 |
| 3,860,739 | 1/1975 | Kloth et al. | 339/99 R |
| 4,002,391 | 1/1977 | Dunn et al. | 339/98 |
| 4,029,384 | 1/1977 | Reinwall, Jr. | 339/98 |
| 4,178,055 | 12/1979 | Fleischhacker et al. | 339/98 |

FOREIGN PATENT DOCUMENTS

| | | | |
|---|---|---|---|
| 2436298 | 2/1976 | Fed. Rep. of Germany | 339/107 |
| 160555 | 3/1933 | Switzerland | 339/107 |

*Primary Examiner*—John McQuade

*Attorney, Agent, or Firm*—Sughrue, Rothwell, Mion, Zinn and Macpeak

[57] ABSTRACT

A rapid-connection terminal for a conductor includes an insulating housing bearing an upwardly open slotted contact blade at its center and parallel sidewalls on opposite sides of the blade which are also slotted, the slots of the insulating housing wall bearing sockets for pinching the insulation covering the conductor. A T-shaped cover functions as a tool and bears projecting tabs which lock within the slots of the housing sidewalls at a widened terminal part whose ends form sockets to further pinch the conductor insulation at the sidewall slots.

12 Claims, 6 Drawing Figures

RAPID-CONNECTION TERMINAL

This is a continuation of application Ser. No. 938,272, filed Aug. 30, 1978 now abandoned.

FIELD OF THE INVENTION

The invention relates to a terminal of the type referred to as a rapid-connection terminal, i.e. a terminal which has a resilient-clip contact which strips the insulation off a conductor when it is inserted and then forms electrical contact with its conductive core.

BACKGROUND OF THE INVENTION

Numerous rapid-connection terminals are known, but it would be an advantage if they were to provide simultaneously locking support of the electrical contact of the conductor core and locking support of the conductor itself on the insulating support of the terminal and optionally a protection device for the visible live metal parts of the terminal.

SUMMARY OF THE INVENTION

The invention aims to produce a terminal which has a number of improvements with respect to the above comments.

The present invention provides a rapid-connection terminal for a conductor formed by a conductive core and an insulating covering, the terminal comprising an insulating housing, enclosing a contact blade which has a slot through which said conductor is inserted and stripped, wherein the slot includes a lock notch near to its opening in which the core of the conductor is locked when inserted therein, after the arms have been resiliently moved apart from the blade, and wherein the insulating housing has first notches which converge on either side of the contact blades towards the inlet of a socket disposed facing the lock notch and in which the insulating covering of the conductor is pinched.

According to a preferred embodiment, the insulating housing has a partition on either side of the contact blade against which the insulating covering of the conductor rests.

The cover has tabs with resilient fixing means on two opposite sides on the insulating housing. The ends of the tabs have widened parts with jaws which constitute resilient clips and inside which the insulating covering of the conductor may be inserted. Such a cover which has stops for bearing against the conductor may be used as a tool for positioning the conductor.

An embodiment of the invention is described by way of example with reference to the accompanying drawings.

DESCRIPTION OF THE PREFERRED EMBODIMENT

Figure 1:
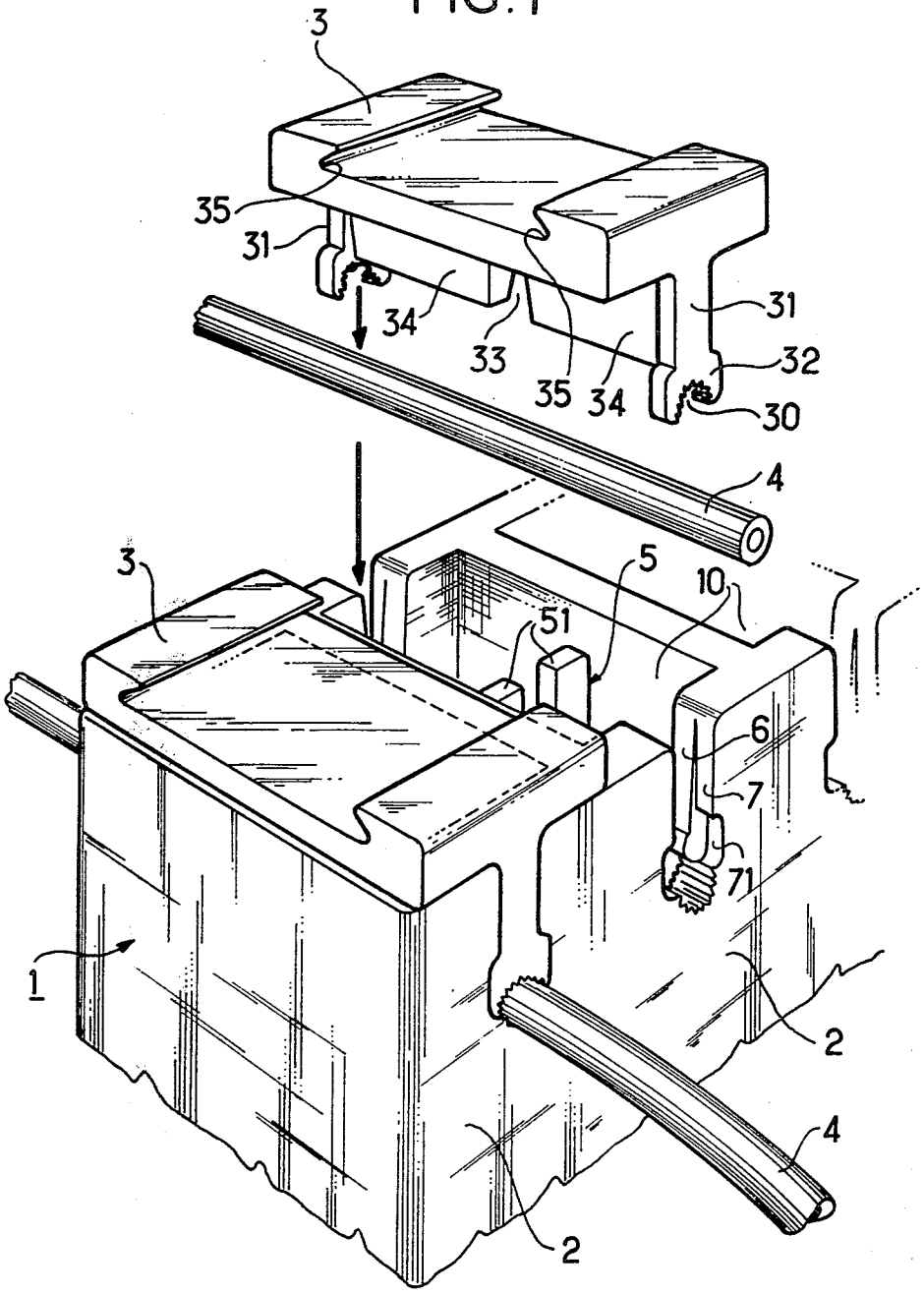
FIG. 1 is a partial perspective view of terminals in accordance with the invention.

FIG. 1 is a partial view of an insulating housing 1 which contains a set of terminals 2 in accordance with the invention. The left-hand terminal is shown connected to a conductor 4 and fitted with an insulating cover 3. The right-hand terminal is shown open prior to insertion of the conductor 4 and the insulating cover 3 into the terminal.

Figure 2:
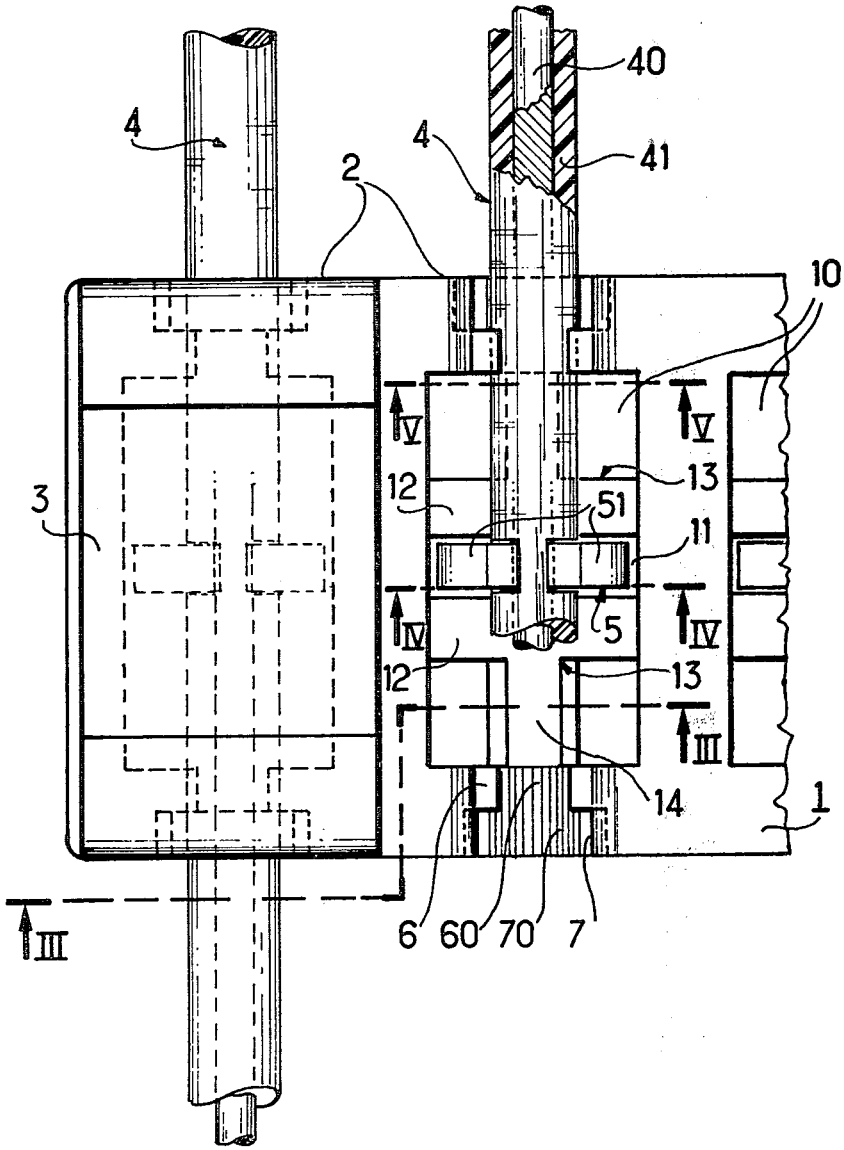
FIG. 2 is a plan view from above of the terminals in FIG. 1.
Figure 4:
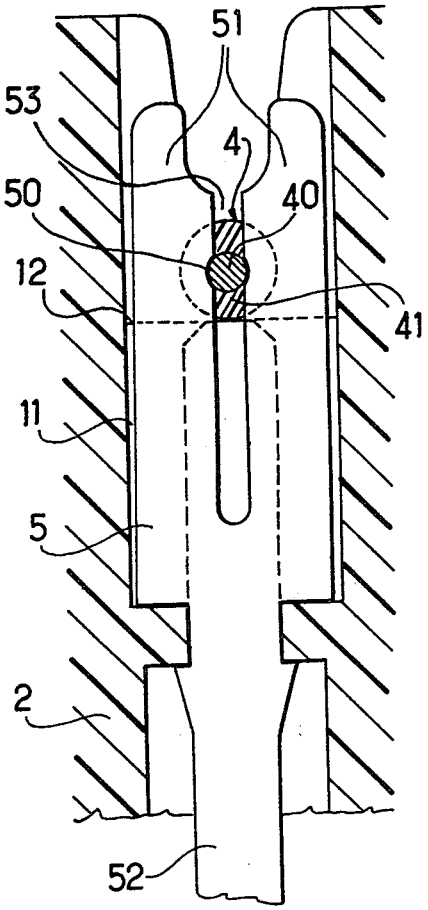
FIG. 4 is a cross-sectional view of the terminals along line IV—IV of FIG. 2.

FIG. 2 is a partial plan view of the terminals 2 of FIG. 1 but with the conductor 4 inserted in opposed circular lock notches 50 disposed on arms 51 near the opening of the parallel sided slot 53 formed between the arms 51 of a through contact blade 5, as shown in FIG. 4. The opposed circular notches define a "lock notch" for the conductor core. The contact blade 5, which is of known type, has, at its lower part, a contact lug 52 for various types of connection such as cable clip, wire-winding, soldering, printed circuit connections, etc.

In FIGS. 1 to 5, the reference 10 designates recesses in the insulating housing 1; contact blades are fixed in the recesses in gaps 11 formed between the parallel flanges 12 of T-shaped partitions 13 whose webs 14 are disposed in line with each other.

Figure 3:
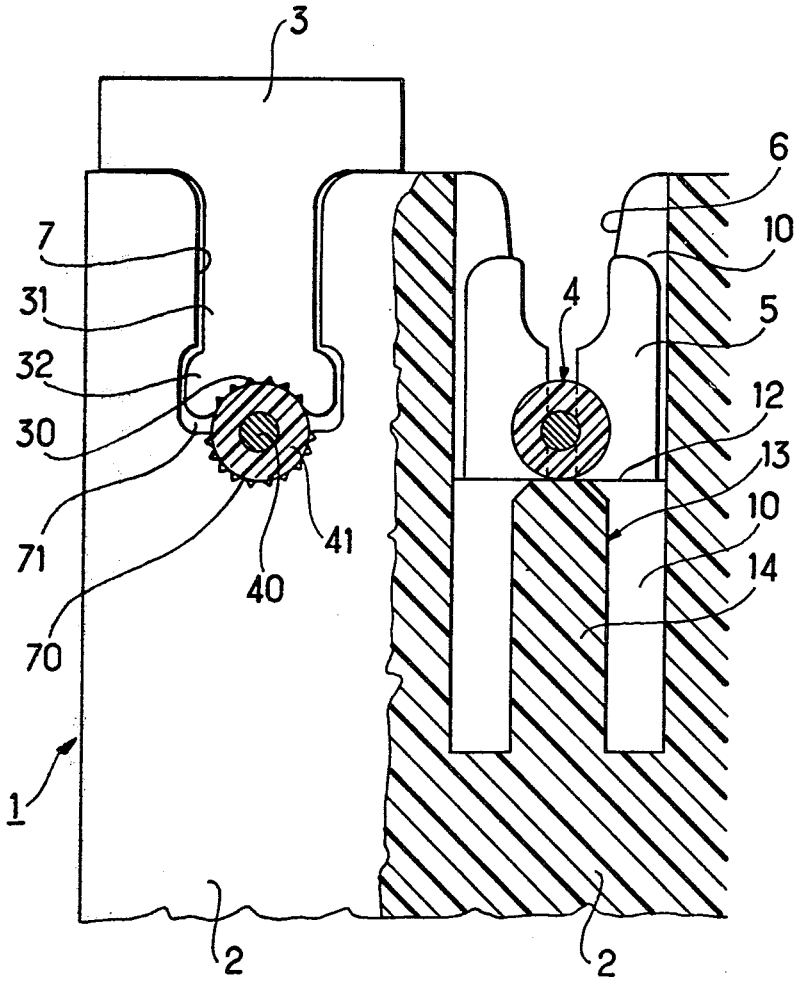
FIG. 3 is a front view and partial cross-section of the terminals along line III—III of FIG. 2.
Figure 5:
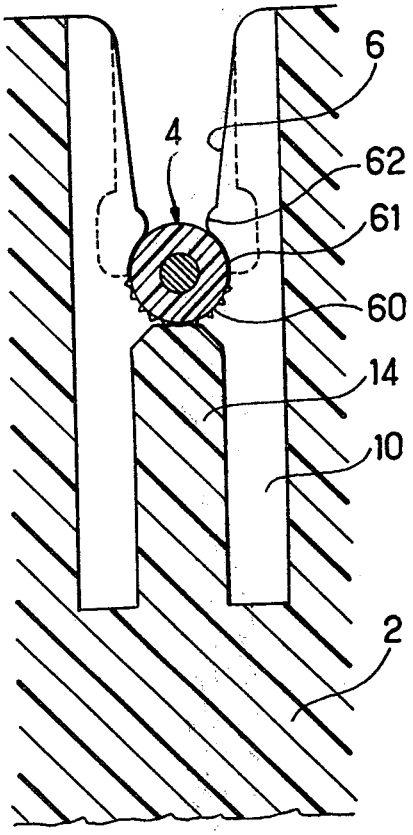
FIG. 5 is a cross-sectional view of the terminals along V—V of FIG. 2.

Two notches—an inner notch 6 and an outer notch 7—are formed in the upper parts of the side walls of the housing 1. FIG. 3 shows the parallel surfaces of the outer notch 7 which lead from its inlet to a widened portion constituted by a recess 71 having a grooved semi-circular base 70. In FIG. 5, the inlet of the inner notch 6 converges towards a throat 62 leading to a circular socket 61 whose base is grooved and in line with the base 70 of the recess 71.

The axis of the socket 61 and of the base 70 coincides with the axis of a lock notch 50 provided between the two arms 51 of the resilient blade 5. The lower points of the bases 60 and 70 coincide with the upper part of the partition 13.

The lower parts of the side surfaces of the insulating cover 3 bear tabs 31 whose ends widen at 32, where a jaw 30 forms a resilient clip with grooved walls similar to those of the base 70. On either side of the cover, there is a tongue 34 extending from the top of the jaw 30 to a central cut-out 33. The upper part of the cover has two parallel grooves 35 inside which an identification label may be inserted.

The terminal operates as follows. The cover 3 may be used to insert the conductor 4 in the terminal. To do this, the conductor 4 is disposed in the jaws 30 of the cover by applying it along the tongues 34. Then, due to the resilience of the clips, the widened ends 32 of the cover are inserted in the outer notches 7 until they are forced into the recesses 71 where they are locked. The conductor 4 is then locked at each end between the base 70 of the recess 71 and the jaw 30, while the grooves bite into the periphery of the insulating covering 41 of the conductor 4. Similarly, due to the tongues 34, the conductor 4 enters the sockets 61 of the notches 6 inside which it is locked, while the grooves of the end 60 bite into the covering 41. Simultaneously, the conductor 4 enters a slot 53 between the arms 51 of the contact blade 5 whose arms 51 strip the covering 41 in a known manner so that the conductive core 40 of the stripped conductor enters the lock notch 50 in which it is locked in the slot 53 due to the resilience of the arms 51 below the notch 50.

Thus, the conductor 4 is electrically and mechanically locked in the lock notch 50, mechanically locked in the sockets 61 and between the recess 71 and the jaw 30.

Further, in this position, the conductor 4 is applied along the partition 13.

After the conductor has been inserted in the terminal, the cover 3 may be removed while still maintaining the first two locking effects.

Figure 6:
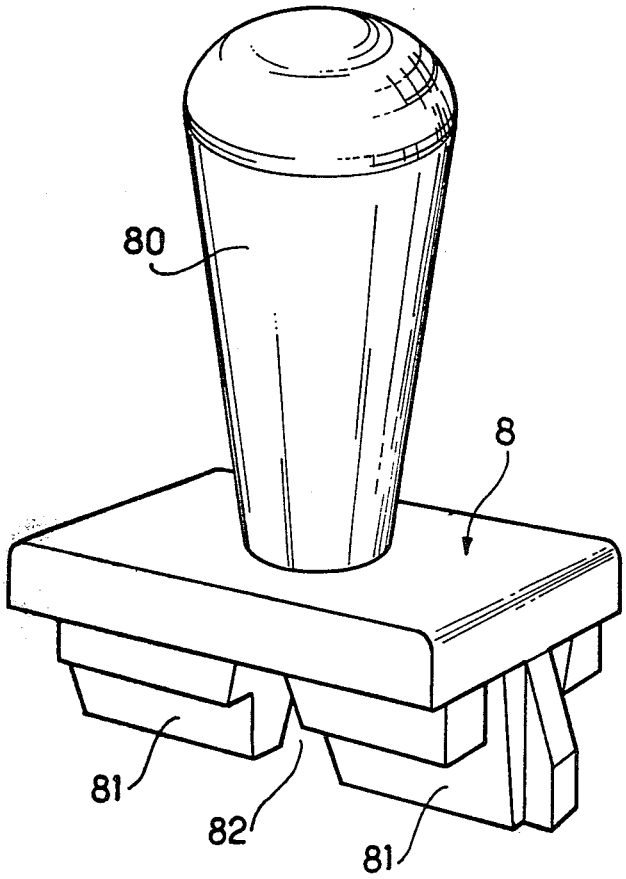
FIG. 6 is a perspective view which shows a tool for inserting the conductor in the terminals in accordance with the invention.

It is also possible to use a tool 8 such as shown in FIG. 6 to insert a conductor 4. The tool has a handle 80 and two tongues 81 instead of the tongues 34 of the cover 3. The tongues 81 are disposed on either side of a cut-out 82, analogous to the cut-out 33 of the cover 3.

The upper ends of the arms 51 of the contact blade 5 may also freely enter the cup-out 82 of the tool. Only the first two locking effects are used with this tool.

It is evident that the invention is in no way limited to the embodiments which have just been described and illustrated and which have been given only by way of example; in particular, without going beyond the scope of the invention, some dispositions may be modified or some means may be replaced by equivalent means or even some components may be replaced by others which are capable of fulfilling the same technical function or an equivalent technical function.

I claim:

1. A rapid-connection terminal for a conductor formed by a conductive core and an insulating covering, said terminal comprising an insulating housing, said housing including laterally opposed, parallel sidewalls, a contact blade mounted within said housing between said walls and in parallel therewith, said blade including a slot opening from one end and forming resilient arms to receive said conductor inserted therein for stripping of the conductor insulating covering, the improvement wherein said arms are oppositely notched on edges forming said slot such that the core of the conductor is locked when inserted therein, and during which the insulating covering is removed from said inserted conductor, and wherein said opposed sidewalls of said insulating housing further comprise first notches aligned with the slot within said blade and which converge in the direction of the blade opening and which terminate at the level of said blade arm edge notches to define a socket to each side of said blade within the insulating housing in which the insulating covering of the conductor is pinched.

2. A terminal according to claim 1, wherein the surface of said socket is grooved longitudinally to frictionally grip the conductor insulating covering during pinching of said insulating covering.

3. A terminal according to claim 1, wherein said terminal further comprises an insulating cover spanning said housing, overlying said spaced walls and said blade and wherein said cover includes projecting tabs having resilient fixing means on opposite sides for resiliently gripping said insulating housing sidewalls respectively, adjacent said first notches for locking said cover to said insulating housing.

4. A terminal according to claim 2, wherein said terminal further comprises an insulating cover spanning said housing, overlying said spaced walls and said blade and wherein said cover includes projecting tabs having resilient fixing means on opposite sides for resiliently gripping said insulating housing sidewalls respectively, adjacent said first notches for locking said cover to said insulating housing.

5. A terminal according to claim 3, wherein the ends of said tabs terminate in jaws constituting resilient clips for locking said cover to said insulating housing, and said clips are recessed on the ends facing the conductor for pinching the conductor on sides opposite said sockets.

6. A terminal according to claim 4, wherein the ends of said tabs terminate in jaws constituting resilient clips for locking said cover to said insulating housing, and said clips are recessed on the ends facing the conductor on sides opposite said sockets.

7. A terminal according to claim 6, wherein the tabs have recesses and the periphery of each recess is grooved to receive the conductor insulating covering.

8. A terminal according to claim 6, wherein each insulating housing sidewall includes a second notch, adjacent said first notch, and said second notch terminates in opposed lateral recesses and said tab jaws are widened with said widened jaws projecting within said opposed lateral recesses to lock said cover to said insulating housing which receive said resilient clips.

9. A terminal according to claim 8, wherein the second notch of each sidewall forms a socket corresponding to the socket of the first notch and being in line therewith and acting to further pinch the insulating cover of the conductor on respective sides of said blade.

10. A terminal according to claim 4, wherein said cover includes tongues disposed in line with the conductor and interposed respectively between said blade and said opposed sidewalls of said housing, and wherein said housing includes a web aligned with said housing wall notches and extending in parallel with and to the opposite side of said cover tongues such that said tongues and said web function to maintain said conductor in position within said housing from one sidewall to the other.

11. A terminal according to claim 4, wherein the outside of the cover bears identification support means.

12. A terminal according to claim 4, wherein said cover functions as a tool for positioning the conductor within the slot of said blade and said first notch of said insulating housing.

* * * * *